US010838337B1

(12) United States Patent
Kazama

(10) Patent No.: US 10,838,337 B1
(45) Date of Patent: Nov. 17, 2020

(54) FIXING DEVICE PROVIDED WITH GRIPPABLE SLEEVE FOR REMOVING AND ATTACHING PRESSURE ROLLER WITHOUT DIRECTLY TOUCHING DRIVE GEAR AND IMAGE FORMING APPARATUS INCORPORATING SAME

(71) Applicant: Yukio Kazama, Kanagawa (JP)

(72) Inventor: Yukio Kazama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/838,034

(22) Filed: Apr. 2, 2020

(30) Foreign Application Priority Data

May 10, 2019 (JP) ..... 2019-089793

(51) Int. Cl.
*G03G 15/20* (2006.01)
*G03G 15/16* (2006.01)

(52) U.S. Cl.
CPC ..... *G03G 15/2053* (2013.01); *G03G 15/161* (2013.01); *G03G 15/1615* (2013.01); *G03G 15/2064* (2013.01)

(58) Field of Classification Search
CPC ..... G03G 15/2017; G03G 15/2035; G03G 15/206; G03G 15/2064; G03G 21/1685
USPC ..... 399/122, 328, 331
See application file for complete search history.

(56) References Cited

U.S. PATENT DOCUMENTS 5,481,347 A * 1/1996 Adachi et al. ..... G03G 15/2064 399/328
8,611,791 B2 * 12/2013 Tokuyama et al. .... G03G 15/20 399/122
8,983,338 B2 * 3/2015 Numazu et al. ... G03G 21/1685 399/122

FOREIGN PATENT DOCUMENTS

| | | |
|---|---|---|
| JP | 7-319315 | 12/1995 |
| JP | 2003-122149 | 4/2003 |
| JP | 2004-029842 | 1/2004 |

* cited by examiner

*Primary Examiner* — William J Royer
(74) *Attorney, Agent, or Firm* — Xsensus LLP

(57) ABSTRACT

A fixing device includes a fixing rotator, a pressure rotator, a gear, and a sleeve. The pressure rotator is configured to contact the fixing rotator to form a fixing nip between the fixing rotator and the pressure rotator. The gear is disposed on an axial end side of the pressure rotator to transmit a driving force. The sleeve extends from the gear in an axial direction of the pressure rotator.

10 Claims, 7 Drawing Sheets

FIXING DEVICE PROVIDED WITH GRIPPABLE SLEEVE FOR REMOVING AND ATTACHING PRESSURE ROLLER WITHOUT DIRECTLY TOUCHING DRIVE GEAR AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2019-089793, filed on May 10, 2019, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

Many components of the fixing device are replaced periodically and upon failures. Maintenance and replacement work are performed depending on the usage situation. Basically, a service person performs the maintenance and replacement work, which influences the load on the service person and the labor cost, leading to a cost burden on a user. To address such a situation, various techniques for enhancing workability have been proposed.

SUMMARY

In one embodiment of the present disclosure, a novel fixing device includes a fixing rotator, a pressure rotator, a gear, and a sleeve. The pressure rotator is configured to contact the fixing rotator to form a fixing nip between the fixing rotator and the pressure rotator. The gear is disposed on an axial end side of the pressure rotator to transmit a driving force. The sleeve extends from the gear in an axial direction of the pressure rotator.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 103 is a schematic view of the handle of FIG. 10A partly accommodated in a drive gear;

The accompanying drawings are intended to depict embodiments of the present disclosure and should not be interpreted to limit the scope thereof. Also; identical or similar reference numerals designate identical or similar components throughout the several views.

DETAILED DESCRIPTION

Figure 1:
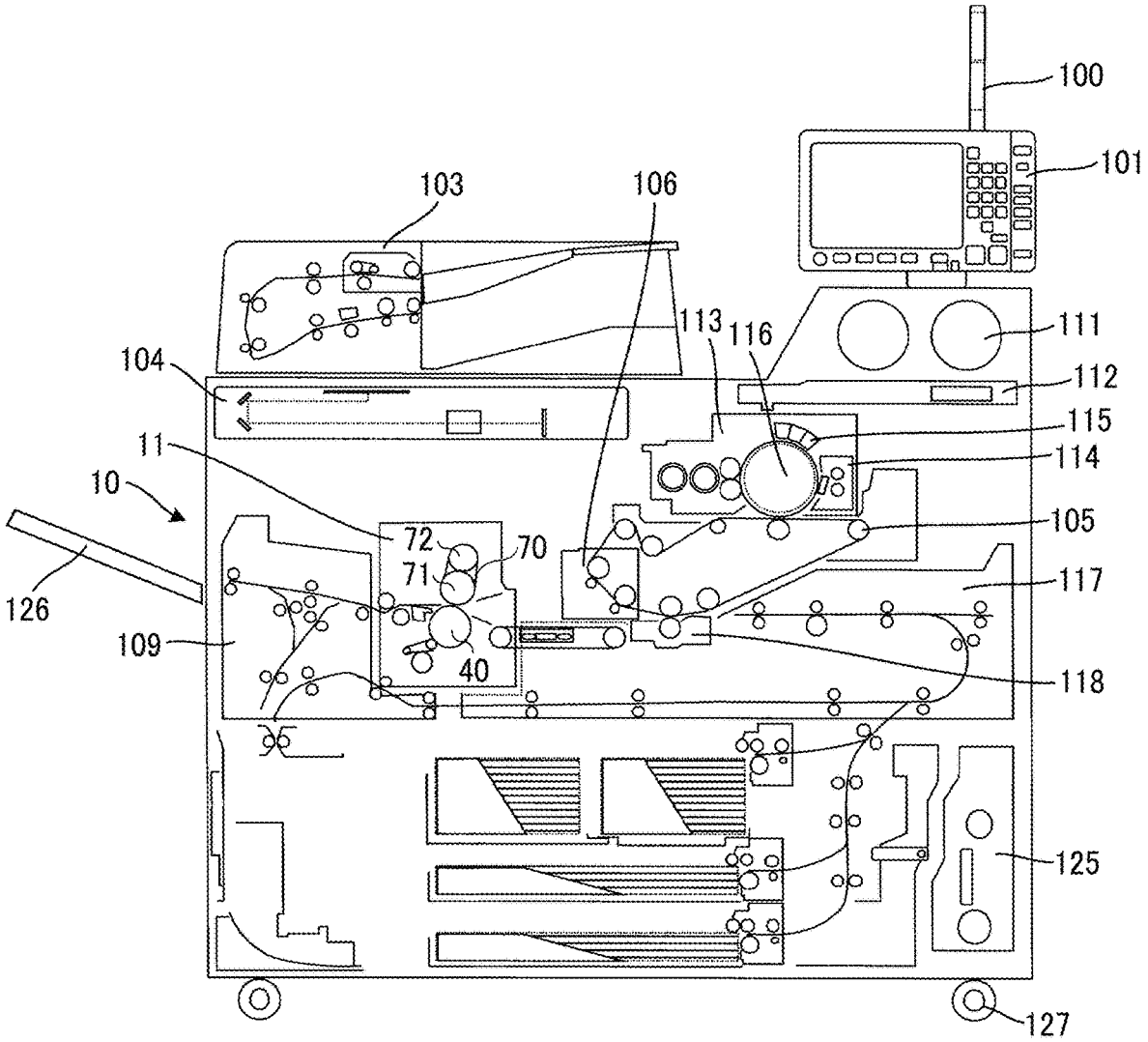
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a," "an," and "the" are intended to include the plural forms as well, unless the context clearly indicates otherwise.

Referring to the drawings, wherein like reference numerals designate identical or corresponding parts throughout the several views, embodiments of the present disclosure are described below.

Initially with reference to FIG. 1, a description is given of a configuration and operation of an image forming apparatus 10 according to an embodiment of the present disclosure.

FIG. 1 is a schematic view of the image forming apparatus 10.

Specifically, the image forming apparatus 10 is a copier that forms monochrome images. The image forming apparatus 10 also functions as a printer when connected to a computer.

Note that the image forming apparatus 10 of the present embodiment is a copier, and therefore, the image forming apparatus 10 includes a document reader serving as a scanner. In a case in which the image forming apparatus 10 is a computer online output dedicated machine serving as a simple printer provided with a built-in controller, the image forming apparatus 10 may exclude the document reader.

The image forming apparatus 10 includes a scanner 104, which accommodates a lighting device, an optical system, a charge-coupled device (CCD) image sensor, and the like inside.

An automatic document feeder (ADF) 103 is disposed above the scanner 104, The ADF 103 automatically conveys a document (i.e., original) placed by, e.g., an operator to a read surface of an exposure glass (i.e., platen) on the scanner 104.

Instead of placing the document on the ADF 103, the operator may place the document on the exposure glass on the scanner 104. Then, the operator selects a mode with function selection keys on an operation panel 101. While confirming the contents displayed on a liquid crystal screen, the operator operates, e.g., ten keys and function keys to set desired image forming conditions. Note that the image forming apparatus 10 includes a call light 100 that indicates an operation status for the operator.

A sensor board unit (SBU) converts an image signal (i.e., analog image data) read by the scanner 104 to digital image data. An optical writer 112 emits laser light to a drum-shaped photoconductor 116, serving as an image bearer, according to the digital image data. Specifically, in the optical writer 112, a cylinder lens condenses laser light. A polygon mirror scans the photoconductor 116 with the condensed laser light in a main scanning direction. Thus, the optical writer 112 forms an electrostatic latent image on the photoconductor 116.

The image forming apparatus 10 includes a developing device 113, a cleaner 114, and a charger 115 around the photoconductor 116, The charger 115 charges an outer circumferential surface of the photoconductor 116.

A power supply unit (PSU) applies a high voltage to the charger 115 via a receptacle, an electrode terminal, a conductive bearing, and the like.

In the developing device 113, fresh toner supplied as necessary from a toner bottle 111 serving as a toner supply is conveyed to a developing roller together with a developer filled in the developing device 113 in advance. The toner and the developer are stirred and mixed by an internal conveying screw while being conveyed to the developing roller. The toner electrostatically attracted by a magnetic force is negatively charged.

The two-component developer borne by the developing roller is regulated by an appropriate amount by developer rising regulators such as a doctor blade and a casing disposed below the developing roller. A bias voltage moves frictionally charged toner of the two-component developer onto the photoconductor 116. The toner selectively adheres to the photoconductor 116 according to the electrostatic latent image formed on the photoconductor 116. Thus, the developing device 113 develops the electrostatic latent image into a visible toner image.

The toner density inside the developing device 113 is detected from a charged amount of the toner by a toner density sensor disposed at a bottom position.

In a primary transfer process in which the toner image is transferred from the photoconductor 116, some of the toner may fail to be transferred and therefore remain on the photoconductor 116 as untransferred or residual toner. The residual toner is scraped off by a cleaning blade of the cleaner 114. Then, the residual toner is conveyed to and collected in a waste toner bottle 125.

Around the developing device 113, entrance seals made of a mylar or a sponge-like material are disposed as appropriate to prevent toner scattering.

The visible toner image formed on the photoconductor 116 is temporarily transferred onto an intermediate transfer belt unit 105.

A sheet conveying device 117 conveys a sheet, serving as a recording medium, such that the sheet passes through a registration roller pair. After passing through the registration roller pair, the sheet passes through an area of contact, herein referred to as a secondary transfer nip, between the intermediate transfer belt unit 105 and a secondary transfer unit 118. At the secondary transfer nip, the toner is transferred onto the sheet from the intermediate transfer belt unit 105 by a positively charged secondary transfer roller of the secondary transfer unit 118.

In a secondary transfer process in which the toner image is transferred from the intermediate transfer belt unit 105, some of the toner may fail to be transferred and therefore remain on the intermediate transfer belt unit 105 as untransferred or residual toner. The residual toner is scraped off by a cleaning blade of a belt cleaner 106. Then, the residual toner is conveyed to and collected in the waste toner bottle 125.

The PSU applies a high voltage to the transfer roller via a receptacle, an electrode terminal, a conductive bearing, and the like.

To restrain fluctuations due to, e.g., the printing environment and the type of the sheet, constant-current control is performed on a transfer current. The transfer current is also switched as appropriate according to an input tray, the size and thickness of the sheet, and the like.

Further, in order to prevent the toner adhering to the transfer roller from contaminating a backside of the sheet, a negative bias is applied to the transfer roller at a given time to return the adhering toner to the intermediate transfer belt unit 105. Accordingly, the transfer roller is cleaned.

The sheet bearing the transferred toner image is conveyed to a fixing device 11, which thermally fuses or fixes the toner image onto the sheet at a fixing temperature under given heat and pressure.

The fixing device 11 includes a fixing roller 71, a thermistor that detects a surface temperature of the fixing roller 71, and a heater that is turned on or off according to the temperature detected by the thermistor. The thermistor may be a contact thermistor or a non-contact thermistor. A thermal fuse is also disposed to prevent overheating.

The fixing device 11 of the present embodiment includes the heater, a fixing rotator and a pressure rotator that rotates in contact with the fixing rotator. In the present embodiment, a fixing belt 70 entrained around the fixing roller 71 and a heating roller 72 serves as a fixing rotator; whereas a pressure roller 40 serves as a pressure rotator. The pressure rotator forms an area of contact, herein referred to as a fixing nip, between the fixing rotator and the pressure rotator. The pressure at the fixing nip is controlled by a cam. A heater may be situated inside the pressure rotator.

Note that the other configuration of the fixing device 11 is deferred.

The sheet bearing the toner image thermally fused is separated from the pressure roller 40 and the fixing belt 70 by a fixing separation plate. Then, the sheet is discharged on an output tray 126 via a reverse sheet discharger 109. Alternatively, the sheet may be subjected to duplex printing according to the settings before being discharged onto the output tray 126. Note that, in a case in which a post-processing device or the like is coupled to the image forming apparatus 10, the sheet is conveyed to a sheet inlet of the post-processing device or the like.

The image forming apparatus 10 further includes a caster 127 to move a body of the image forming apparatus 10.

The image forming apparatus 10 of the present embodiment forms an image by electrophotography with the configuration and operation described above.

Figure 2:
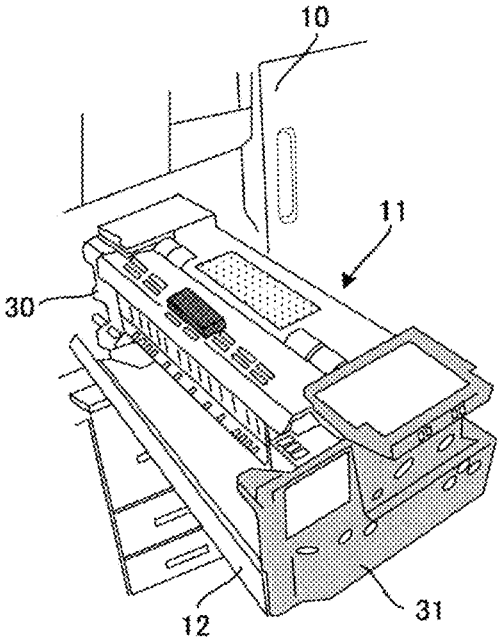
FIG. 2 is a schematic perspective view of a fixing device incorporated in the image forming apparatus.
Figure 3:
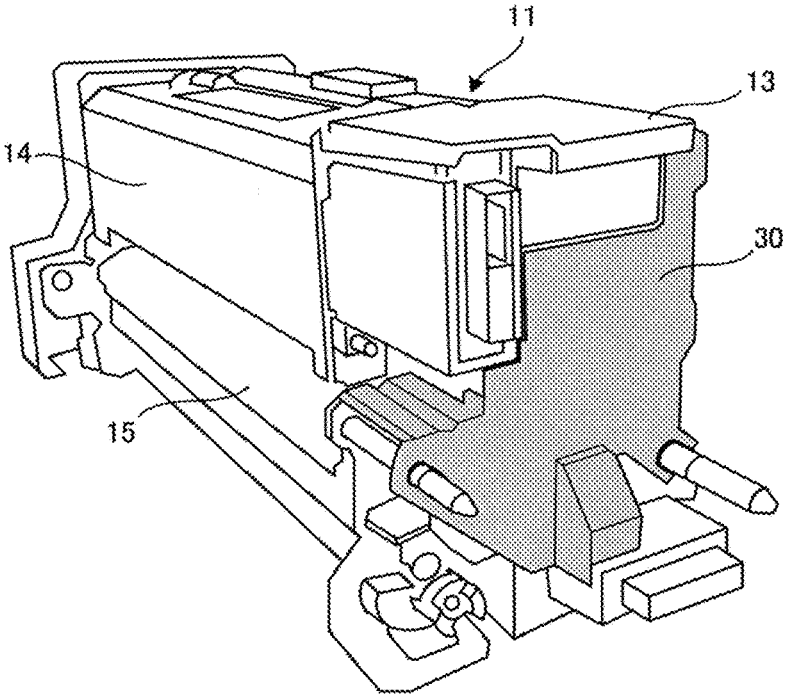
FIG. 3 is a schematic perspective view of an external appearance of the fixing device.
Figure 4:
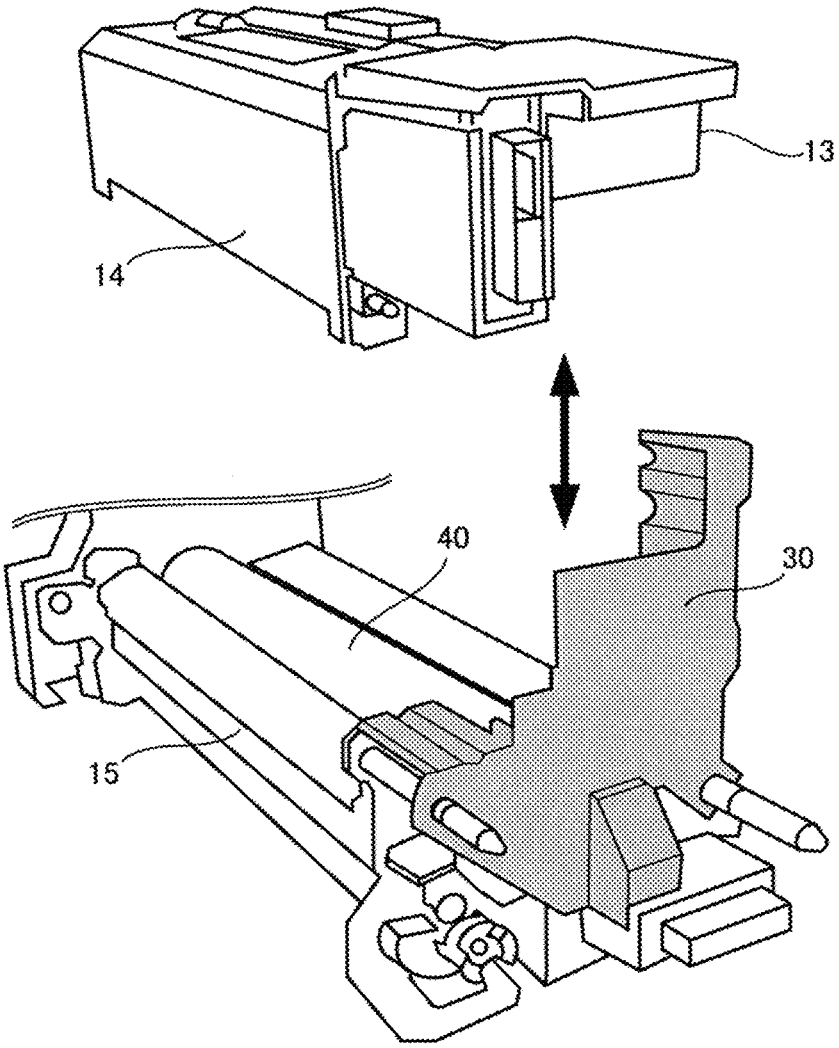
FIG. 4 is an exploded perspective view of the fixing device of FIG. 3, illustrating upper and lower units of the fixing device.

Referring now to FIGS. 2 to 4, a description is given of a configuration of the fixing device 11.

FIG. 2 is a schematic perspective view of the fixing device 11 incorporated in the image forming apparatus 10 described above. FIG. 3 is a schematic perspective view of an external appearance of the fixing device 11. FIG. 4 is an exploded perspective view of the fixing device 11 of FIG. 3, illustrating upper and lower units of the fixing device 11.

As described above, the fixing device 11 of the present embodiment includes, e.g., the heater, the fixing rotator (e.g., fixing roller, fixing belt), and the pressure rotator (e.g., pressure roller) that contacts the fixing rotator to form the fixing nip between the fixing rotator and the pressure rotator.

As illustrated in FIG. 2, the fixing device 11 of the present embodiment is mounted on a slide rail 12 disposed inside the image forming apparatus 10 so as to be pulled out of the image forming apparatus 10.

The fixing device 11 includes an inner cover 30 and an outer cover 31 on an image forming apparatus 10 side (i.e., back side) and a front side, respectively, in a direction in which the fixing device 11 is pulled out of the image forming apparatus 10.

FIGS. 3 and 4 illustrate the fixing device 11 removed from the image forming apparatus 10.

As illustrated in FIG. 4, the fixing device 11 includes a separation unit 13 and a heating unit 14 as upper units and a pressure unit 15 as a lower unit separable from the upper units.

The pressure unit 15 includes the pressure roller 40. Note that the heating unit 14 includes, e.g., the fixing rotator and the heater. At least one of a roller and a belt serves as a fixing rotator.

Now, a description is given of a procedure of maintenance (e.g., replacement of parts) of the fixing device 11.

Firstly, the fixing device 11 mounted on the slide rail 12 is pulled out after a halt of a printing operation of the image forming apparatus 10 illustrated in FIG. 2. At this time, preferably, the fixing device 11 is sufficiently cooled down before being pulled out.

Subsequently, the fixing device 11 is removed from the slide rail 12 and placed on a workspace to be ready for a maintenance work.

The fixing device 11 is vertically dividable into the upper units, namely, the separation unit 13 and the heating unit 14, and the lower unit, namely, the pressure unit 15 as illustrated in FIG. 4, by removal of fasteners coupling the upper and lower units.

After the fixing device 11 is divided into the upper and lower units, the maintenance work is performed on a target unit such as replacement of parts.

After the maintenance work is completed, the upper and lower units are coupled. Then, the fixing device 11 is mounted on the slide rail 12. Finally, the fixing device 11 is accommodated in the image forming apparatus 10.

Generally, upon replacement of a roller such as the pressure roller 40 and a halogen heater inside the roller, a drive gear and an idler gear disposed on an axial end side of the roller are to be removed together with, e.g., a heater harness extending from the heater.

To reduce mutual wear of such gears during rotation, a lubricant is applied to the gears. Since the components of a fixing device that performs thermal fixing are generally exposed to high temperature of about 160° C. to about 170° C. and some assemblies of the fixing device are exposed to high temperature of about 200° C., a heat-resistant grease having a high viscosity and an excellent heat resistance is applied as the lubricant to the gears. Therefore, the heat-resistant grease may adhere to fingers of an operator when the operator grips the gears. In a case in Which the heat-resistant grease on the fingers adheres to other parts, unfavorable situations may arise. For example, a printed matter or the clothes of the operator may be stained.

To address such unfavorable situations, the fixing device 11 of the present embodiment includes a handle with which, e.g., an operator removes and attaches the roller without touching gear surfaces bearing the heat-resistant grease.

Referring now to FIGS. 5A to 11B, a description is given of some examples of the sleeve serving as a handle.

Figure 5A:
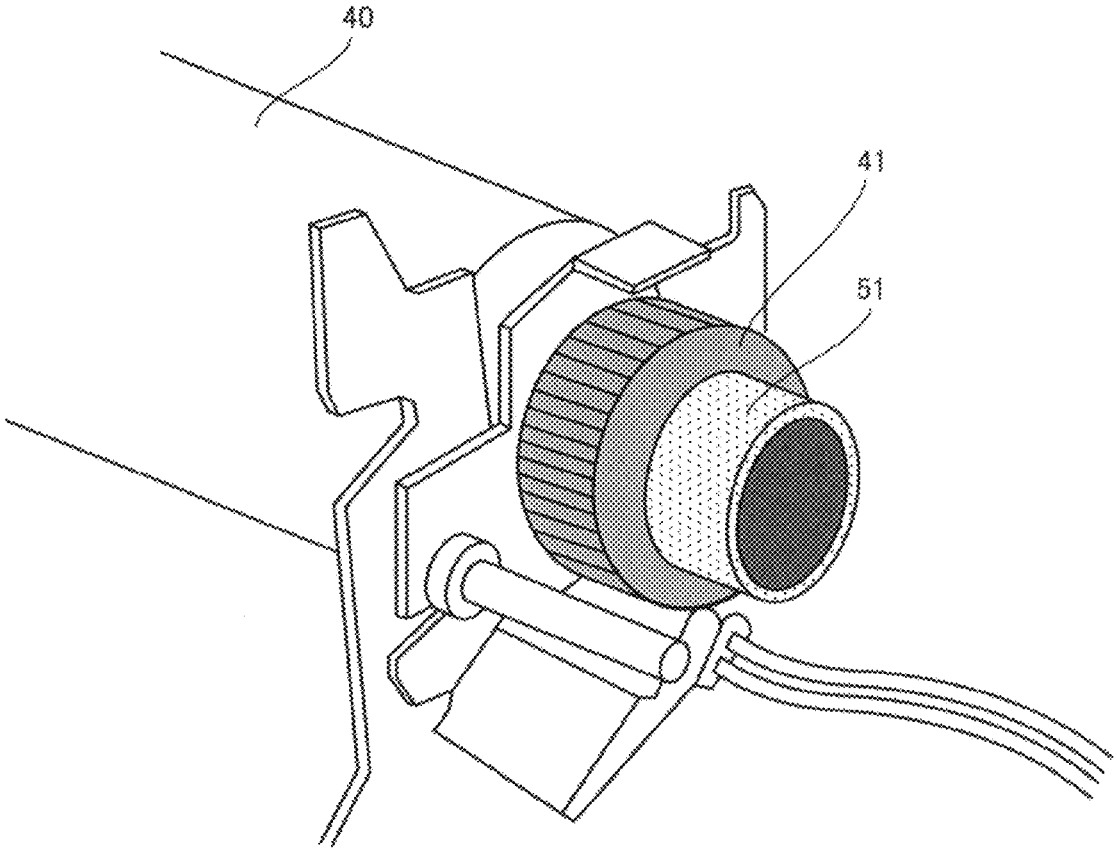
FIG. 5A is a partial perspective view of the fixing device of FIG. 4, illustrating a handle disposed on a drive gear.
Figure 5B:
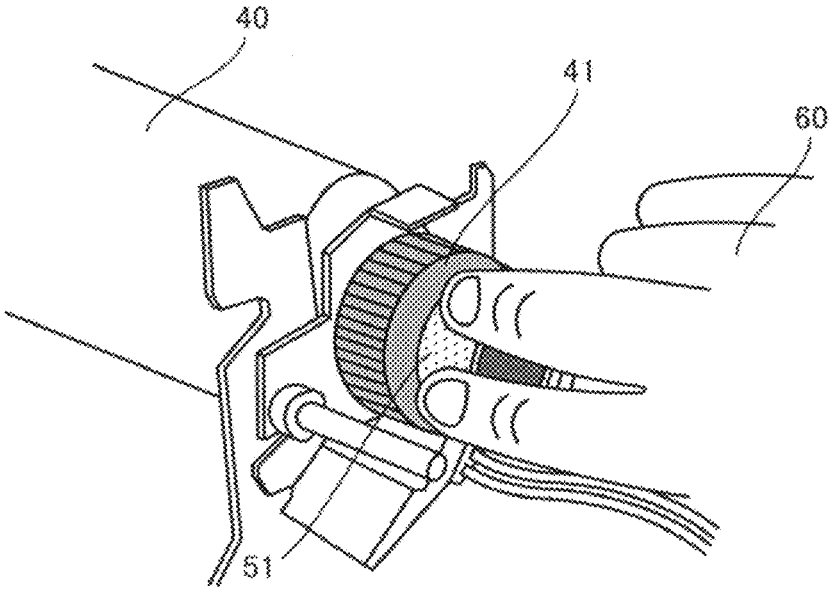
FIG. 5B is another partial perspective view of the fixing device of FIG. 4, illustrating fingers of an operator gripping the handle.
Figure 6:
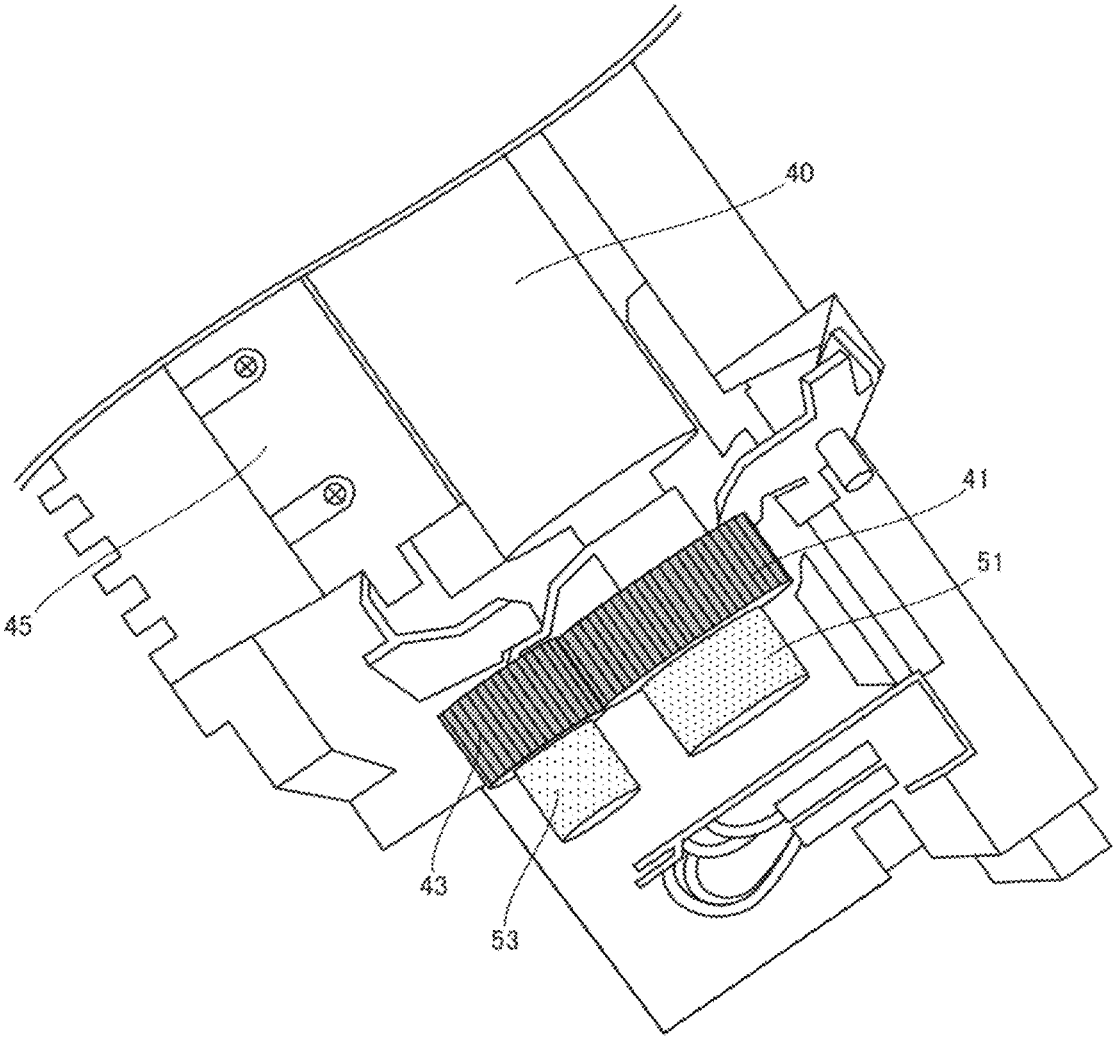
FIG. 6 is a partial top view of the fixing device of FIG. 4, illustrating handles disposed on a drive gear and an idler gear, respectively.

FIG. 5A is a partial perspective view of the fixing device 11 of FIG. 4, illustrating a sleeve 51 serving as a handle disposed on a drive gear 41. FIG. 5B is another partial perspective view of the fixing device 11 of FIG. 4, illustrating fingers 60 of an operator gripping the sleeve 51. FIG. 6 is a partial top view of the fixing device 11 of FIG. 4, illustrating the sleeve 51 and a sleeve 53 serving as handles disposed on the drive gear 41 and an idler gear 43, respectively.

As illustrated in FIGS. 5A to 6, the fixing device 11 of the present embodiment includes a plurality of gears and the sleeve 51. The plurality of gears is disposed on an axial end side of pressure roller 40 to transmit a driving force from a driver. The sleeve 51 extends from the drive gear 41 in an axial direction of the pressure roller 40. The plurality of gears includes, e.g., a plurality of drive gears and an idler gear.

As illustrated in FIG. 59, the sleeve 51 is grippable (or holdable) by the fingers 60 of the operator.

As illustrated in FIGS. 5A and 5B, since the pressure roller 40 is provided with the sleeve 51 that is grippable by the operator, the operator can remove and attach the pressure roller 40 without directly touching the drive gear 41.

FIG. 6 is a top view of the pressure unit 15 as a unit that includes the pressure roller 40.

As illustrated in FIG. 6, the pressure roller 40 is provided with the drive gear 41, the idler gear 43, and the sleeves 51 and 53 on the axial end side of the pressure roller 40. The drive gear 41 transmits the driving force from the driver. The idler gear 43 meshes with the drive gear 41. The sleeves 51 and 53 extend from the drive gear 41 and the idler gear 43, respectively, in the axial direction of the pressure roller 40. The pressure unit 15 includes a separation plate 45.

A description is herein given of the drive gear 41 and the sleeve 51 extending from the drive gear 41 as a representative of gears and sleeves extending from the gears. That is, the same description is applicable to the idler gear 43 and the sleeve 53 extending from the idler gear 43. Similarly, the same description is applicable to other gears and other sleeves extending from the other gears.

Figure 7:
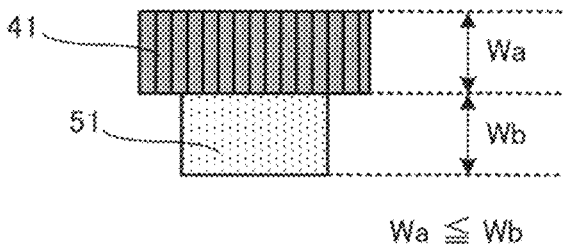
FIG. 7 is a schematic view of a handle incorporated in the fixing device, according to a first embodiment of the present disclosure.

Referring now to FIG. 7, a description is given of a first embodiment of the present disclosure.

FIG. 7 is a schematic view of the sleeve 51 serving as a handle incorporated in the fixing device 11, according to the first embodiment of the present disclosure.

As illustrated in FIG. 7, a relation of $Wa \leq Wb$ is preferably satisfied, where Wa represents a length of the drive gear 41 in the axial direction of the pressure roller 40 and Wb represents a length of the sleeve 51 in the axial direction of the pressure roller 40.

A relatively wide area where the fingers 60 contact the sleeve 51 allows the operator to stably hold the sleeve 51.

Figure 8:
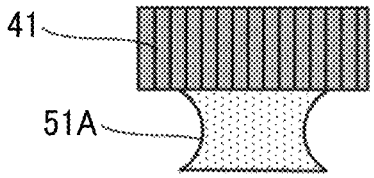
FIG. 8 is a schematic view of a handle incorporable in the fixing device, according to a second embodiment of the present disclosure.

Referring now to FIG. 8, a description is given of a second embodiment of the present disclosure.

FIG. 8 is a schematic view of a sleeve 51A serving as a handle incorporable in the fixing device 11, according to the second embodiment of the present disclosure.

As illustrated in FIG. 8, the sleeve 51A has an hourglass shape with a center portion of the sleeve 51A smaller in diameter than an end portion of the sleeve 51A.

Since a cross section of the sleeve 51A has a gentle concave shape, an operator can easily grip the sleeve 51A, In other words, the operator can stably hold the sleeve 51A.

Figure 9:
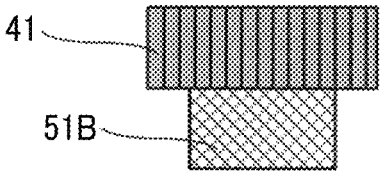
FIG. 9 is a schematic view of a handle incorporable in the fixing device, according to a third embodiment of the present disclosure.

Referring now to FIG. 9, a description is given of a third embodiment of the present disclosure.

FIG. 9 is a schematic view of a sleeve SIB serving as a handle incorporable in the fixing device 11, according to the third embodiment of the present disclosure.

As schematically illustrated in FIG. 9, the sleeve 519 has a knurled outer circumferential surface. That is, the sleeve 51B has an outer circumferential surface with fine unevenness.

The knurled outer circumferential surface of the sleeve 51B is efficacious in slip resistance, allowing an operator to stably grip and operate the sleeve 51B.

Figure 10A:
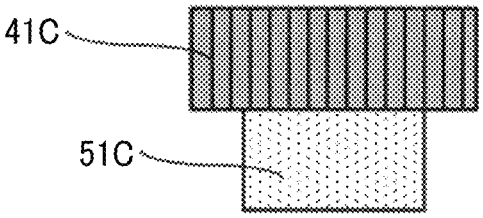
FIG. 10A is a schematic view of a handle incorporable in the fixing device, according to a fourth embodiment of the present disclosure.
Figure 10B:
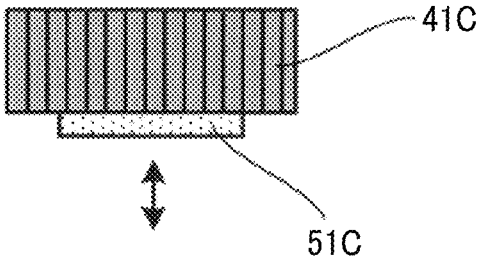

Referring now to FIGS. 10A and 10B, a description is given of a fourth embodiment of the present disclosure.

FIG. 10A is a schematic view of a sleeve 51C serving as a handle incorporable in the fixing device 11, according to the fourth embodiment of the present disclosure. FIG. 10B is a schematic view of the sleeve 51C of FIG. 10A partly accommodated in a drive gear 41C.

As illustrated in FIGS. 10A and 10B, the drive gear 41C has a space in which the sleeve 51C is accommodable. The sleeve 51C is slidable in the axial direction of the pressure roller 40.

As the sleeve 51C slides in the axial direction of the pressure roller 40, at least part of the sleeve 51C is accommodated inside the drive gear 41C or exposed outside the drive gear 41C.

Preferably, at least part of the sleeve 51C is accommodated inside the drive gear 41C during a fixing operation and exposed outside the drive gear 41C during maintenance. Such a configuration attains room on the layout of the pressure unit 15 and prevents a surface of the sleeve 51C from being contaminated by toner scattered during the fixing operation.

Figure 11A:
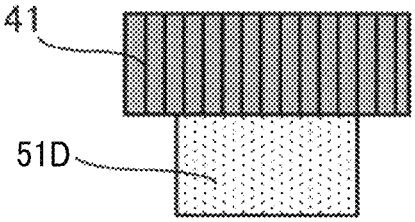
FIG. 11A is a schematic view of a handle incorporable in the fixing device, according to a fifth embodiment of the present disclosure.
Figure 11B:
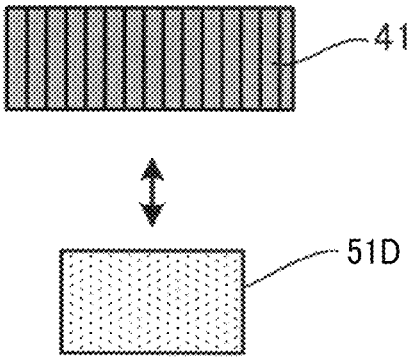
FIG. 11B is a schematic view of the handle of FIG. 11A removed from a drive gear.

Referring now to FIGS. 11A and 11B, a description is given of a fifth embodiment of the present disclosure.

FIG. 11A is a schematic view of a sleeve 51D serving as a handle incorporable in the fixing device 11, according to the fifth embodiment of the present disclosure. FIG. 11B is a schematic view of the sleeve 51D of FIG. 11A removed from the drive gear 41.

As illustrated in FIGS. 11A and 11B, the sleeve 51D is removable from the drive gear 41. The sleeve 51D is configured to be removed from the drive gear 41 during a fixing operation. Such a removal of the sleeve 51D during the fixing operation attains room on the layout of the pressure unit 15 as in the fourth embodiment described above and prevents a surface of the sleeve 51D from being contaminated by toner scattered during the fixing operation.

Although a description has been given of some examples of the drive gear (e.g., drive gear 41) and the sleeve (e.g., sleeve 51) disposed on an axial end side of the pressure roller 40, the sleeve may be disposed on an axial end side of a rotator other than the pressure roller 40. A rotator, as a component of the fixing device 11, provided with a gear is also providable with the sleeve.

As described above, according to the present embodiment, the fixing device 11 includes a sleeve (e.g., sleeve 51) serving as a handle. The handle allows an operator to remove and attach a roller without touching a gear surface bearing a heat-resistant grease, thereby preventing the heat-resistant grease from adhering to fingers of the operator. As a result, contamination of, e.g., parts is prevented. Accordingly, the workability of removing and attaching the roller is enhanced upon maintenance and replacement of parts. Since the fingers are not contaminated by the heat-resistant grease during the work, the operator can comfortably and quickly remove and attach the roller.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a fixing rotator;

a pressure rotator configured to contact the fixing rotator to form a fixing nip between the fixing rotator and the pressure rotator;

a gear disposed on an axial end side of the pressure rotator to transmit a driving force; and a sleeve extending from the gear in an axial direction of the pressure rotator.

2. The fixing device according to claim 1, wherein the sleeve is grippable.

3. The fixing device according to claim 1, wherein a relation of $Wa \leq Wb$ is satisfied, where Wa represents a length of the gear in the axial direction of the pressure rotator and Wb represents a length of the sleeve in the axial direction of the pressure rotator.

4. The fixing device according to claim 1, wherein the sleeve has an hourglass shape with a center portion of the sleeve smaller in diameter than an end portion of the sleeve.

5. The fixing device according to claim 1, wherein the sleeve has a knurled outer circumferential surface.

6. The fixing device according to claim 1, wherein the gear has a space in which the sleeve is accommodable, wherein the sleeve is slidable in the axial direction of the pressure rotator, and wherein the sleeve is configured to be accommodated inside the gear during a fixing operation.

7. The fixing device according to claim 1, wherein the sleeve is removable from the gear, and wherein the sleeve is configured to be removed during a fixing operation.

8. The fixing device according to claim 1, wherein the fixing rotator is one of a roller and a belt.

9. The fixing device according to claim 1, wherein the pressure rotator is a roller.

10. An image forming apparatus comprising:

an image bearer configured to bear a toner image; and the fixing device according to claim 1, configured to fix the toner image onto a recording medium.

* * * * *